United States Patent [19]

Phillips

[11] 4,020,284

[45] Apr. 26, 1977

[54] SPEAKER SYSTEM

[75] Inventor: William W. Phillips, Rancho Palos Verdes, Calif.

[73] Assignee: Shaymar, Inc., Beverly Hills, Calif.

[22] Filed: Oct. 22, 1975

[21] Appl. No.: 624,607

[52] U.S. Cl. ..... 179/1 E; 179/146 H

[51] Int. Cl.[2] ..... H04R 1/32

[58] Field of Search ..... 179/146 R, 146 H, 1 E, 179/1 G, 1 GP; 325/352

[56] References Cited

UNITED STATES PATENTS

| | | | |
|---|---|---|---|
| 1,692,737 | 11/1928 | Hemming | 179/179 |
| 1,952,514 | 3/1934 | Selby | 179/1 B X |
| 3,944,020 | 3/1976 | Brown | 179/146 H X |

*Primary Examiner*—William C. Cooper
*Attorney, Agent, or Firm*—Kleinberg, Morganstern, Scholnick & Mann

[57] ABSTRACT

A stereo speaker system for portable use having two loud speakers mounted side by side in a common housing which may be divided. The housing substantially surrounds the speakers and the speakers substantially occupy the chamber defined by the housing. The chamber has two ducts for directing the sound produced toward the listener's ears. These ducts open into the speaker chamber adjacent the speakers.

25 Claims, 7 Drawing Figures

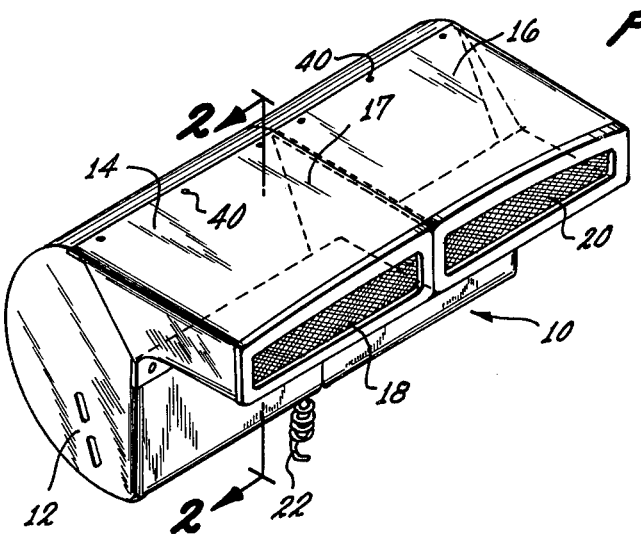
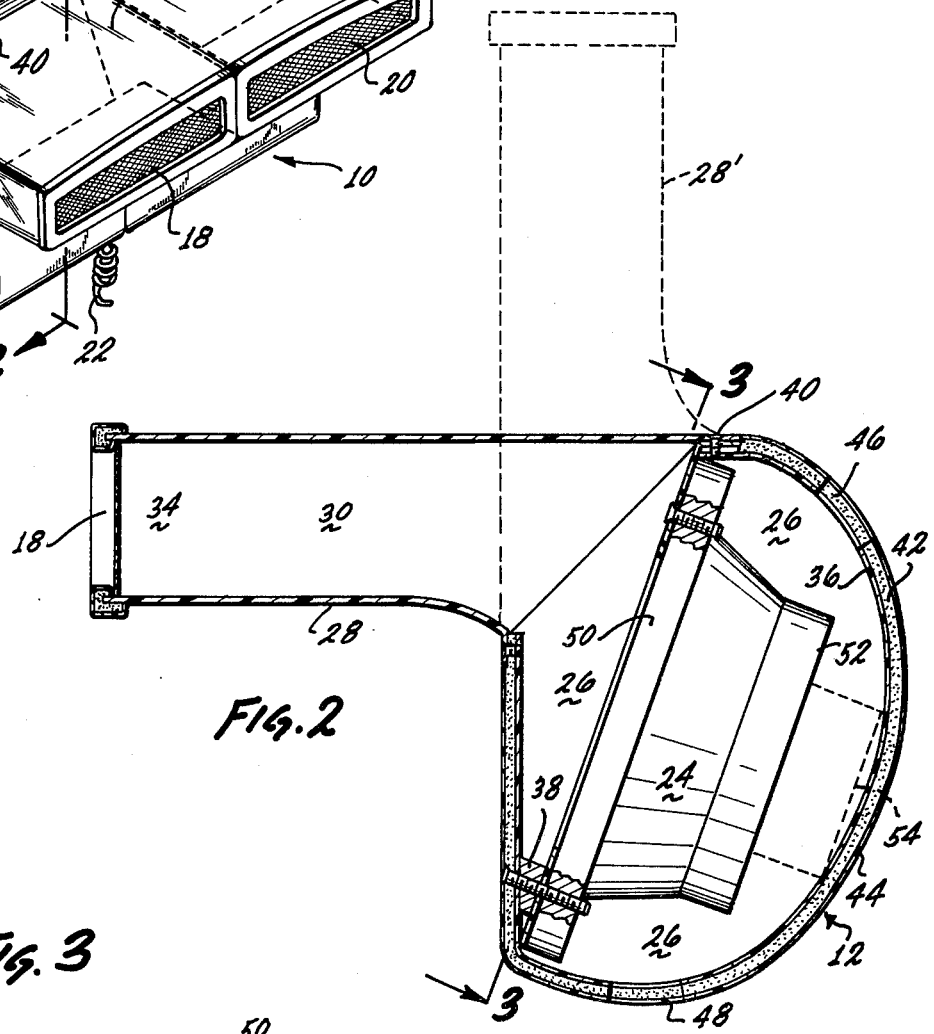
FIG. 2
FIG. 3
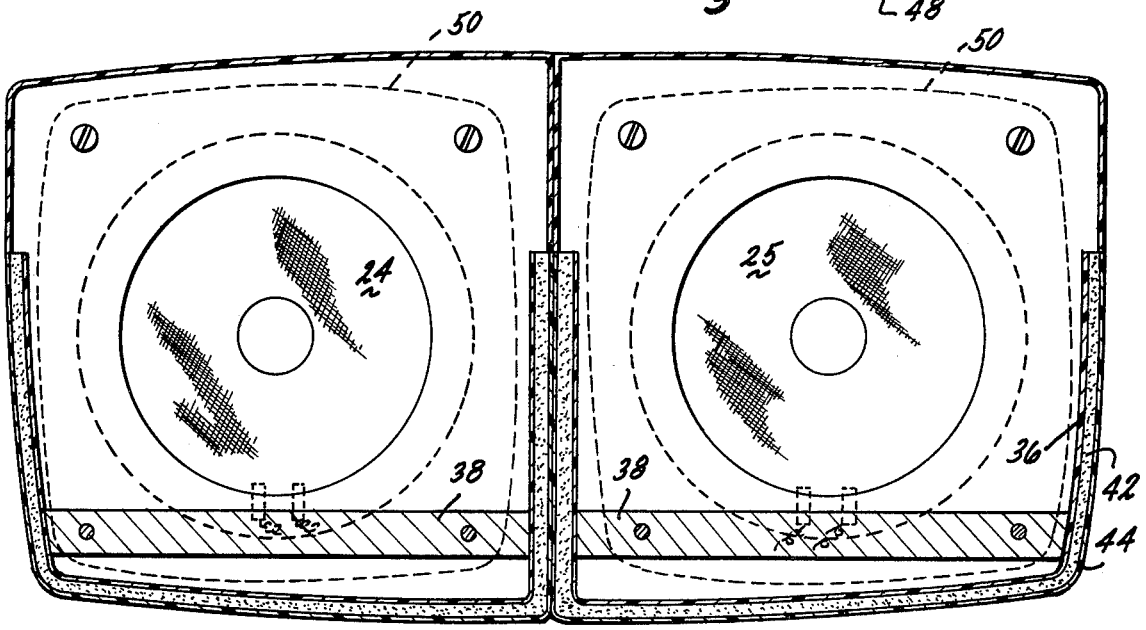

SPEAKER SYSTEM

BACKGROUND OF THE INVENTION

1. Field of the Invention

The present invention is in the field of loud speaker systems and particularly relates to a stereo speaker system and enclosure suitable for portable use.

2. The Prior Art

It has long been known in the art that a unique synergistic effect results when two loud speakers are used to reproduce the sounds picked up respectively by two separated microphones. The listener is subjected to the illusion that the reproduced sound is originating at various points around him. Recently it has become known that this effect can be enhanced by the use of four rather than two sound channels to produce a so-called quadraphonic sound.

It is well known that loud speakers can be mounted in a wide variety of locations. U.S. Pat. No. 3,230,320 to Kerr, shows a speaker mounted on each side of the head rest of a dental chair. U.S. Pat. No. 3,237,713 to Leslie, shows two speakers mounted on opposite sides within a helmet-like acoustical chamber for providing individualized instructions to a student in a classroom. In U.S. Pat. No. 2,541,980, Antone shows a single loud speaker mounted to a hair dryer. All three of these inventions tend to limit the sideward vision of the listener and to limit his ability to move about.

A number of inventions have placed speakers in vehicles for various purposes. U.S. Pat. No. 1,997,408 to Holmes, shows a single speaker attachable to the back of a seat on its front surface at one side and positionable vertically relative to the listener's ear. U.S. Pat. No. 3,158,835 shows speakers mounted on the inside of a car closest to the operator's left ear and on the interior top of the car an equal distance from the operator's right ear for use in a safety device to permit the driver to sense the sounds outside the automobile. U.S. Pat. No. 2,908,766 to Taylor, shows a pair of speakers mounted on the front side of a seat back on the left and right sides of a passenger's head. These three inventions all have in common the disadvantage that the passenger's sideward vision is obscured by the speakers, and in the event the vehicle lurches sidewardly, the passenger's head will be thrown against the speakers.

An alternative to speakers is the use of head phones. Unfortunately, head phones are not comfortable to wear for long periods of time, and they restrict the ability of the listener to move about freely. Certain types of head phones interfere with the listener's coiffure. When used in a vehicle, head phones are definitely a hazard because they shut out all outside sounds, whether or not the head phones are in operation.

Thus, the need can be seen for a stereo speaker system which does not obscure the listener's vision, which does not restrain his freedom of movement, and which, when mounted in a vehicle, will not shut out all outside sounds and which will not present a safety hazard to the listener in the event of a crash.

SUMMARY OF THE INVENTION

The speaker system of the present invention cannot obscure the listener's vision because it is mounted behind the listener at a point below eye level. It presents no physical constraints on the listener's ability to shift his position or otherwise move about. When used in a vehicle, the speaker system of the present invention does not shut out outside sounds, and, because it is mounted on the back side of the seat back, it presents no impact hazard to the listener. The system is removably attachable to the listener's seat in one embodiment, and can be removed from the seat and taken outside the vehicle for entertainment. Alternatively, the system can be unplugged from the vehicle for use elsewhere with another stereo or monaural system. The system generates a unique quality of sound which in several embodiments can be felt as well as heard.

The speaker system of the present invention is intended for operation with two-channel or four-channel stereo systems with or without the use of additional speakers. The system may, of course, be operated monaurally by feeding identical signals to both speakers.

The system comprises at least two loud speakers, one for the left channel and one for the right channel. These speakers are mounted in a unique enclosure (housing).

In one embodiment, the enclosure is divided into two compartments in which the speakers are mounted, each compartment having a duct for chanelling the sound to an appropriate location with respect to the listener's ears.

In another embodiment, the enclosure is provided with brackets for hanging the system removably over the top of any seat back, with the speaker system positioned on the back surface of the seat back. The brackets permit the speaker system to be attached to any desired object ranging from the headboard of a bed to a branch of a tree.

In still another embodiment, a portable radio receiver is included with the speaker system to provide a portable entertainment system. Further, the enclosure can be provided with a harness of straps for attaching the speaker system to the listener's back at shoulder height, like a back pack.

The enclosure is of a relatively rigid material such as plastic, and its interior surfaces may be provided with sound absorbing material. The walls of the enclosure reverberate from the sound produced and this reverberation can be felt by the listener on his back and in his chest cavity. The dimensions of the enclosure are smaller than the wave length of all but the higher pitched sounds and as a result, little interference takes place, although there is a general enhancement of the bass frequencies. The enclosure communicates with a duct through which the sound is channelled and from which the sound is transmitted. The duct produces a trumpet effect which tends to direct the sound from the left speaker toward the listener's left ear and to direct the sound from the right speaker to the listener's right ear.

In one embodiment, the duct portion is detachable from the remainder of the enclosure to permit the directionality of the unit to be suppressed if desired in certain applications. In another embodiment, the detachable duct portion may be reattached to the remainder of the enclosure in an alternative position, to alter the directionality of the unit.

In general, the speakers are located behind the listener and at shoulder level approximately. The ducts normally direct the sound in a forward and upward direction towards the listener's ears. The theory of the speaker system is based on the realization that the listener's impression of directionality is based upon the phase differences between the channels during reproduction, rather than on the direction from which the sound waves actually originate as in "live listening".

In another embodiment, portions of the exterior of the enclosure are provided with a layer of foamed plastic both to protect the enclosure, and if the system is used in a vehicle, to prevent passengers seated in the seat behind that to which the speaker is attached from being injured by the enclosure in the event of a crash.

With the system of the present invention, outside sounds are not shut out. The listener can hear the outside sounds, particularly if he chooses to concentrate on them. This is in contrast to the situation with head phones, where the outside sounds are never available to the listener's ears. Thus, if mounted in an automobile, the present invention would not prevent the listener from hearing the sounds produced by emergency vehicles and other traffic sounds, as would head phones. Because the speaker system of the present invention is not worn on the listener's head, it cannot spoil the listener's coiffure.

The speaker system produces a unique quality of stereo sound, described as clear and brilliant but with a firmer and louder bass compared to conventional systems.

The novel features which are believed to be characteristic of the invention, both as to organization and method of oeration, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

BRIEF DESCRIPTION OF THE DRAWINGS

FIG. 1 is a perspective view of a preferred embodiment of the present invention;

FIG. 2 is a side cross-sectional view of the preferred embodiment taken along the direction indicated in the perspective drawing;

FIG. 3 is an oblique front cross-sectional view of the preferred embodiment shown in FIG. 1 taken along the line indicated in FIG. 2;

DESCRIPTION OF THE PREFERRED EMBODIMENT

Figure 4:
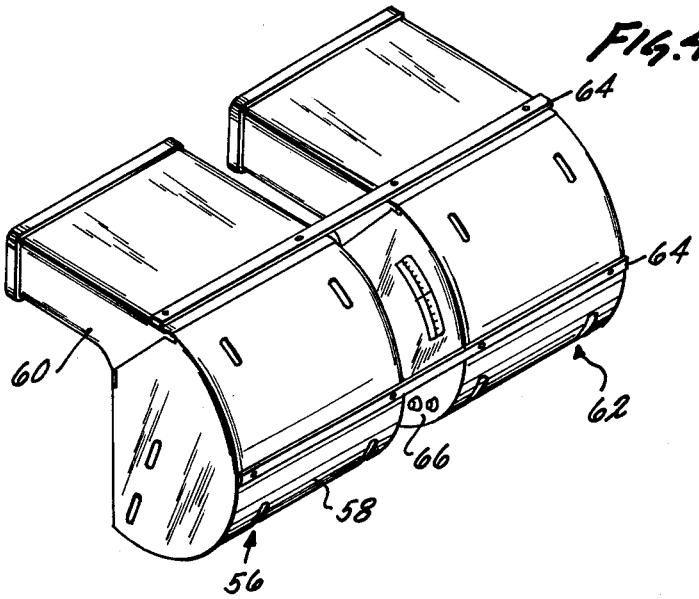
FIG. 4 is a perspective view of an alternative embodiment.

Turning now to the drawings, there is shown in FIG. 1 a perspective view of a preferred embodiment of the present invention. The speaker system 10 includes an enclosure or housing 12 containing the loud speaker assemblies and the portable radio, if one is included. The system further includes ducts 14 and 16 which define passages 18 and 20, respectively, for directing the sounds produced by the loud speaker assemblies in predetermined directions. If the speaker system is to be used with an external stereo system or radio, a lead wire 22 may be included to carry the electrical signals from the remote radio or stereo set to the speaker system 10.

A loud speaker assembly, as used in connection with the present invention may typically include "woofer", "tweeter" and mid-range components to permit each speaker assembly to reproduce with greater fidelity the sounds represented by a single electrical signal. For stereo use, two such speaker assemblies are generally used deriving their signals from two separate electrical signals: a right signal and a left signal. As used in connection with the present invention, the term "loud speaker assembly" refers to speakers of the type commonly used in household radios and hi-fi sets. Thus, the loud speaker assemblies referred to herein do not include head phones and like devices. The speaker system 10 of FIG. 1 may be seen in greater detail in FIG. 2.

FIG. 2 is a cross-sectional view in a lateral direction shown by the arrows 2—2 of FIG. 1. The enclosure 12, also referred to as a housing, contains a loud speaker assembly 24 of the type described above, and defines a chamber 26 in which the loud speaker assembly is mounted. As shown in FIG. 2, loud speaker assembly 24 occupies a substantial portion of the chamber 26.

Loud speaker assembly 24 has a front side 50 normally facing the listener and a back side 52. Housing 12 is provided with a number of holes, such as 46 and 48 on the portion of it adjacent the back side of the speaker. These holes provide for a flow of air in and out of chamber 26 as the cone of the loud speaker assembly vibrates. If the holes were not present, the amplitude of vibration would be reduced and the volume of sound produced by the speaker, particularly in the bass range, would be reduced because of the cushioning effect of the air trapped within chamber 26.

Housing 12 further includes a duct portion 28 which defines a passage 30 connecting the chamber 26 with the space outside the housing. In one embodiment, duct 28 is provided at its outer end 34 with a decorative grille, as shown in FIGS. 1 and 2.

Figure 5:
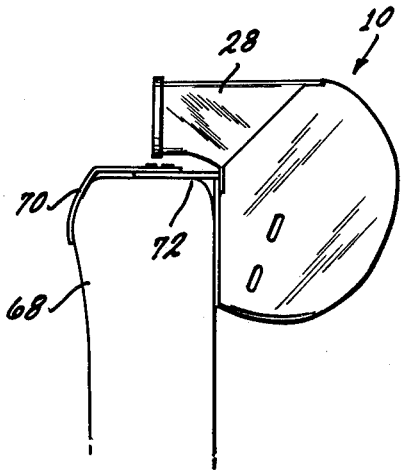
FIG. 5 is a side view showing the preferred embodiment attached to the back of a seat.
Figure 6:
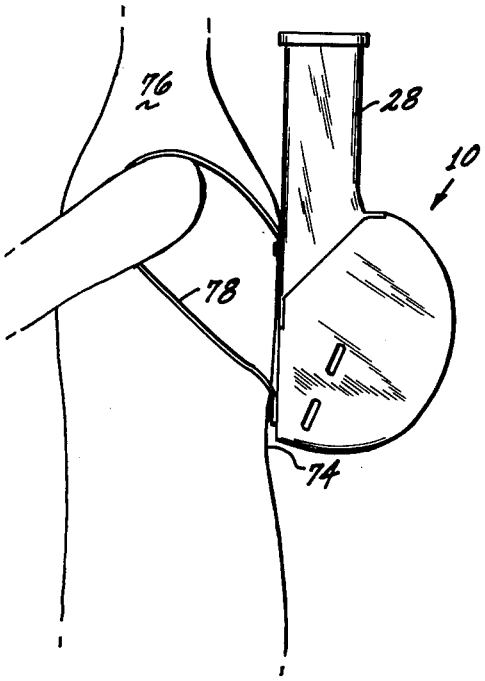
FIG. 6 is a side view showing the speaker system attached to the back of the listener.
Figure 7:
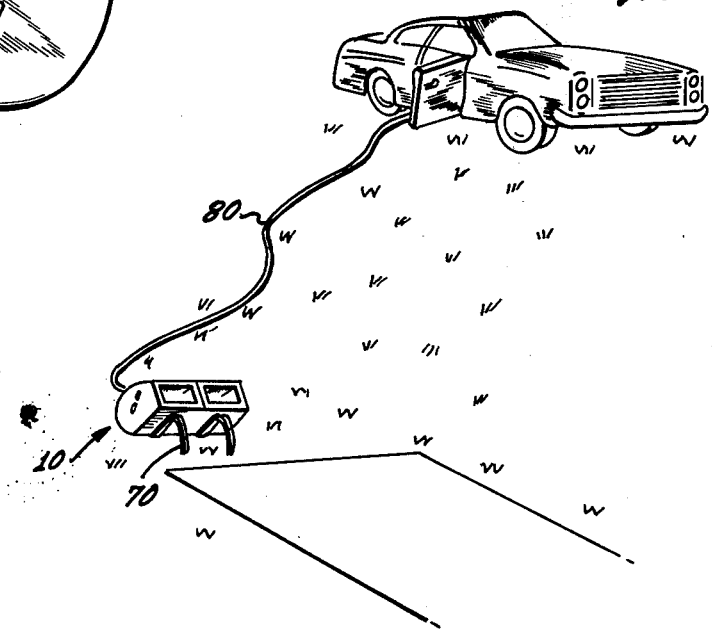
FIG. 7 is a perspective view showing the recreational use of a speaker system.

In a preferred embodiment, the duct portion 28 can be detached from the remainder of the housing, for applications where a less directional sound is desired as shown in FIG. 7. Some directionality is produced by a ducting effect that results from mounting the speaker within the enclosure as shown in FIG. 2, with the front of the speaker inclined away from the planar surface of the enclosure at an acute angle. In a preferred embodiment, the detachable duct portion 28 may be reattached to the remainder of the housing in an alternative position 28', shown by the dashed lines in FIG. 2. The ability to change the position of the duct portion 28 greatly adds to the versatility of the speaker system, enabling it to be conveniently located, for example, on a seat back as shown in FIG. 5, on the listener's back as shown in FIG. 6, or, with the duct in position 28', on the deck behind the rear seat in certain automobiles.

Housing 12 further includes positionind portions 38 and 40 for defining the positions of the loud speaker assembly 24 within the chamber 26. A great number of ways of attaching the loud speaker assembly 24 to the housing 12 will be obvious to those skilled in the art.

Because it is anticipated that the speaker system will be used in automobiles, it is important that the housing 12 be constructed in a manner which will not present a hazard to the driver or passengers, even in the event of an accident. For such automotive applications, it is visualized that duct portion 28 would be semi-rigid and that the entire enclosure 12, possibly but not necessarily including duct portion 28, would have a layer 42 of resilient material attached to the outer surface of the wall 36 of housing 12. This resilient material will absorb impact shocks, thus cushioning the passengers from direct contact with the rigid shell 36 of the housing. The resilient layer 42 may further comprise a tough pliable outer skin 44 to protect the underlying resilient layer. The resilient layer 42 may be of a foamed rubber or suitable foamed plastic material.

If it is desired to make the speaker system truly portable, a small optional radio receiver 54, shown by dashed lines in FIG. 2 may be included within the housing 12. This radio receiver may be adapted for receiving stereo or monaural broadcasts. In other embodiments, a separate radio receiver could be attached to the outside of housing 12.

For stereo operation it is contemplated that two loud speaker assemblies will be used in the present invention. A number of options are available regarding the design of the enclosure to be used with the two speaker assemblies.

FIG. 3 is an oblique front cross-sectional view along the line indicated by the arrows 3—3 of FIG. 2. In the preferred embodiment the speakers 24 and 25 are mounted within a common enclosure. As shown in FIG. 1, this common enclosure has two ducts 14 and 16 defining two passages 18 and 20, respectively. Alternatively, the duct portion may be described as consisting of a single duct divided by a septum into two passages 18 and 20. It has been found unnecessary to divide the portion of the housing which encloses the speaker assemblies. However, in alternative embodiments such as that shown in FIG. 4, each speaker assembly may be provided with its own housing 58 and duct portion 60, units such as 56 and 62, may be used singly or in pairs depending on whether one wishes to generate stereo or monaural sounds. As shown in FIG. 4, units 56 and 62, enclosing only a single speaker assembly may be mounted side by side in a framework 64 with a space between the units as shown in FIG. 4. Alternatively, the units shown in FIG. 4 may be physically connected on their opposing sides so as to form a single connected unit similar to that of FIG. 1 but divided into two separate compartments and two separate ducts. All of these configurations fall within the scope of the present invention.

The description given above in connection with FIG. 2 relative to the structure of the enclosure and the mounting of the speaker assembly within the enclosure is equally valid for the units 56 and 62 shown in FIG. 4. If desired, a portable radio 66 may be included in the space between the units 56 and 62, and the radio 66 may be either of the stereo or monaural type.

FIG. 5 is a side view showing the back 68 of a seat, to which a speaker system 10 has been attached. A bracket 70 is provided to facilitate attachment of the speaker system 10 to the back 68 of the seat. The duct portion 28 extends around the top portion 72 of the seat back 68 on its right and left hand sides. In this position, duct portion 28 channels the sound produced to the left and right ears of a person sitting in the seat.

FIG. 6 shows another embodiment of the present invention, wherein the speaker system 10 is attached to the back 74 of a listener 76 by a harness 78 of straps. For this application, the duct portion 28 has been attached to the remainder of the housing in the alternative position 28' of FIG. 2. It is particularly desirable in the embodiment of FIG. 6 to include within the speaker system a portable radio so that the listener can enjoy the sounds wherever he goes. In this embodiment, duct portion 28 channels the sounds upward towards the listener's ears.

When the speaker system of the present invention is used in an automobile, it may be operated from signals generated by a radio or tape unit mounted in the automobile. As shown in FIG. 5, the speaker system is readily detachable from the seat of the automobile. Thus, if a long extension speaker cord 80 is available, the speaker system 10 may readily be removed from the car to a remote location, while at the same time the speaker system derives its power and signals from the automobile system as shown in FIG. 7.

Thus, there has been described a speaker system having an unique housing, including a duct portion for channeling the sound generated toward the listener's ears.

Unlike head phones, the speaker system does not attach to the listener's head and does not block out external sounds from the listener's ears. This in turn permits a listener who is driving a car to hear the sounds of traffic about him.

The speaker system of the present invention does not restrict the listener's ability to move about, nor does it obscure his vision.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. An enclosed loud speaker system for converting applied electrical signals to sounds and for directing the sounds toward a listener's ears without contacting the listener's ears, comprising:

two loud speaker assemblies, each including at least one loud speaker; and a housing of a rigid material substantially surrounding said speaker assemblies on all sides to form a chamber substantially occupied by said speakers, having two ducts for directing the sounds produced by said speakers. toward the listener's ears each duct defining a passage from said chamber to the space outside said housing, and opening into said chamber at a location adjacent one of said loud speaker assemblies, said housing having positioning portions on its inside surface to define the position of said loud speaker assemblies within said chamber.

2. For use with a seat having a back, the enclosed loud speaker system of claim 1 further comprising means for holding said housing against the rear surface of the back of the seat, and wherein said ducts extend forward over the seat back on its left and right sides.

3. The enclosed loud speaker system of claim 1 further comprising means for holding said housing against the back of the listener, and wherein said ducts extend in a generally upward direction on the left and right sides of the listener.

4. The combination comprising the enclosed loud speaker system of claim 1 and further comprising a radio receiver coupled to said speaker system.

5. The combination of claim 4 wherein said radio receiver is a stereo radio receiver, said receiver providing distinct outputs to each of said loud speaker assemblies.

6. An enclosed loud speaker system comprising:

two loud speaker assemblies, each including at least one loud speaker; and a housing of a rigid material substantially surrounding said speaker assemblies on all sides to form a chamber substantially occupied by said speakers, having a duct portion defining a passage from said chamber to the space outside said housing, said housing having positioning portions on its inside surface to define the position of said loud speaker assemblies within said chamber.

7. The enclosed loud speaker system of claim 6 wherein said duct is divided into two passages by a septum and wherein each of said two passages opens into said chamber at a location adjacent one of said loud speaker assemblies.

8. The combination comprising the enclosed loud speaker of claim 6 and further comprising a radio receiver, coupled to said speaker assemblies.

9. The combination of claim 8 wherein said radio receiver is a stereo radio receiver, said receiver providing distinct outputs to each of said loud speaker assemblies.

10. A loud speaker comprising:

a first loud speaker assembly including at least one loud speaker;

a first housing of a rigid material substantially surrounding said first loud speaker assembly on all sides to form a chamber substantially occupied by said first loud speaker assembly, having a duct portion defining a passage from the chamber to the space outside said housing, and having positioning portions on its inside surface to define the position of said first loud speaker assembly within the chamber;

a second loud speaker assembly including at least one loud speaker;

a second housing of a rigid material substantially surrounding said second loud speaker assembly on all sides to form a chamber substantially occupied by said second loud speaker assembly, having a duct portion defining a passage from the chamber to the space outside said housing, and having positioning portions on its inside surface to define the position of said second loud speaker assembly within the chamber; and, structural supporting and positioning means attached to said first housing and said second housing for supporting said housings and maintaining a predetermined separation between them.

11. The loud speaker system of claim 10 further comprising a source of audio frequency electrical signals coupled to said first loud speaker assembly and to said second loud speaker assembly.

12. The loud speaker system of claim 10 further comprising means for attaching said loud speaker system to the back of a seat.

13. The loud speaker system of claim 10 further comprising means for supporting said loud speaker system against the back of a human listener.

14. The loud speaker system of claim 10 wherein said duct portions are detachable from their housings.

15. An enclosure for a loud speaker assembly comprising a housing of a rigid material substantially surrounding the speaker assembly on all sides to form a chamber substantially occupied by the speaker assembly, having a duct portion defining a passage from the chamber to the space outside said housing, the exterior surface of said housing being substantially covered by a layer of resilient material.

16. The enclosure of claim 15 wherein said layer of resilient material is foamed plastic.

17. An enclosure for a loud speaker assembly comprising a housing of a rigid material substantially surrounding the speaker assembly on all sides to form a chamber substantially occupied by the speaker assembly, having a duct portion defining a passage from the chamber to the space outside said housing, said duct portion being detachable from the remainder of said housing and attachable to the remainder of said housing in more than one orientation.

18. For use by a listener, the enclosure of Claim 17 further comprising means for holding said housing against the back of the listener.

19. For use with a seat having a back, the enclosure of Claim 17 further comprising means for mounting said housing adjacent the top of the back of the seat.

20. The enclosure of Claim 17 wherein said housing has a planar surface and wherein said duct is attachable to said housing in an orientation not intersecting said planar surface, whereby said enclosure can be positioned against a flat mounting surface.

21. For use with a seat having a back, the enclosure of Claim 17 further comprising means for holding said housing against the rear surface of the back of the seat.

22. An enclosure for a loud speaker assembly having a front surface from which sound emanates, said enclosure comprising a housing of a rigid material substantially surrounding the speaker assembly on all sides to form a chamber substantially occupied by the speaker assembly, said housing having a substantially planar wall portion adjacent an aperture for emitting sound and having positioning portions on its inside surface to position the loud speaker assembly with its front surface adjacent said planar wall portion at an acute angle with respect to it and facing said aperture.

23. For use with a seat having a back, the enclosure of claim 22 further comprising means for mounting said housing adjacent the top of the back of the seat.

24. The enclosure of claim 22 further comprising means for mounting said housing with its planar wall portion against a flat mounting surface.

25. For use with a seat having a back, the enclosure of claim 22 further comprising means for holding said housing against the rear surface of the back of the seat.

* * * * *